United States Patent [19]

von Maydell

[11] Patent Number: 4,494,437

[45] Date of Patent: Jan. 22, 1985

[54] ARRANGEMENT IN LOW-FLYING WEAPONS CARRIERS FOR COMBATING GROUND TARGETS

[75] Inventor: Ignaz von Maydell, Munich, Fed. Rep. of Germany

[73] Assignee: Messerschmitt-Bölkow-Blohm Gesellschaft mit beschränkter Haftung

[21] Appl. No.: 116,025

[22] Filed: Jan. 23, 1980

[51] Int. Cl.[3] ..... F41H 13/00

[52] U.S. Cl. ..... 89/1.51; 89/1.11; 102/213

[58] Field of Search ..... 89/1.5 R, 1.5 E, 1 A; 102/211–214

[56] References Cited

U.S. PATENT DOCUMENTS 1,621,654 3/1927 Boos ..... 89/1.5 R
2,925,965 2/1960 Pierce ..... 102/213
4,160,415 7/1979 Cole ..... 102/214
4,245,560 1/1981 Rambauske ..... 102/213

FOREIGN PATENT DOCUMENTS 301358 6/1920 Fed. Rep. of Germany .
1182113 11/1964 Fed. Rep. of Germany .

*Primary Examiner*—Charles T. Jordan
*Attorney, Agent, or Firm*—Toren, McGeady and Stanger

[57] ABSTRACT

In a low-flying weapons carrier, such as a manned or remote control aircraft, a weapon is arranged to fire steeply downwardly at ground targets. The weapon can fire a plurality of separate ammunition members. A release for the weapon is located in the weapons carrier and a target detector separate from the weapon is associated with the release. The target detector is directed steeply downwardly parallel to the velocity vector of the ammunition members to be discharged by the weapon.

11 Claims, 3 Drawing Figures

Fig. 2
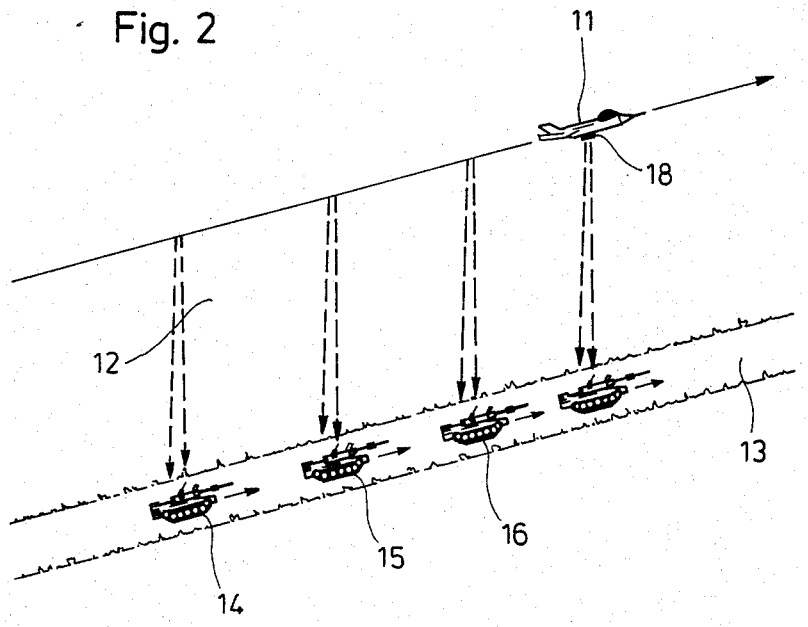
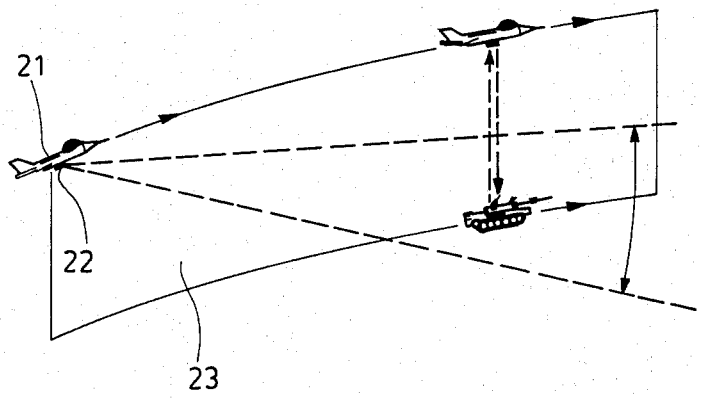
Fig. 3

ARRANGEMENT IN LOW-FLYING WEAPONS CARRIERS FOR COMBATING GROUND TARGETS

The invention relates to an arrangement in low-flying weapons carriers for combatting ground targets which are to be attacked with a weapon having steeply downwardly directed ballistics.

Arrangements of the above-mentioned type have the purpose of making it possible to successfully combat stationary and particularly also moving ground targets independently from weather conditions while requiring little ammunition and being subject to a relatively low self-risk.

Because of a highly developed defense on the ground, an attack of ground targets can only be carried out at a high risk for the attacker with the known weapons which are dropped from a flying weapons carrier. The weapons carrier is forced to release its weapons from safe distances which become greater and greater, or to carry out the attack by low-level flying at near-sonic speeds.

With increasing distances at which the weapons are released and in the case of unfavorable weather conditions, the hit probability significantly decreases and requires a large amount of ammunition and very expensive guiding and aiming devices in the flying weapons carrier. For reducing the expenses required for the latter, in our older patent application P 25 32 479.2, a method was described wherein a highly accurate homing approach is achieved by means of radio distance measuring equipment data which, on the one hand, are stored in the weapons carrier and are compared to additional, continuously formed radio distance measuring equipment data. In our additional older patent application P 26 27 183.0, there is further described an arrangement in flying weapons carriers for combatting ground targets, in which a new type of weapon having perpendicularly downwardly directed ballistics is used for increasing the hit accuracy. This arrangement with the guiding method according to our older application provided particularly for the use in remote control missiles has the disadvantage that it can only be used against stationary ground targets.

It is the object of the invention to construct arrangements for a weapon of the type mentioned in the latter patent specification in such a way that the weapon can be used universally in manned and remote-controlled, low-flying weapons carriers and, in addition to combatting stationary ground targets, facilitates also the combatting of moving ground targets.

In an arrangement in low-flying weapons carriers for combatting ground targets which are to be attacked by means of a weapon having steeply downwardly directed ballistics, this object is met by assigning to the release of the weapon a target detector of relatively short reach which is directed steeply downwardly and parallel to the direction of the resulting velocity vector of the ammunition to be discharged.

In accordance with further developments of the invention, for the selection of targets, the target detector is provided with sensors which respond to different properties of the target, in which at least the threshold value of one of the sensors of the target detector is adjustable.

For combatting targets having great iron masses and/or motor drives, according to a further development of the invention, there are provided an active or passive sensor for evaluating the terrestrial magnetic field surrounding the target and/or a sensor responding to stray electromagnetic fields of electrically excited systems and/or a sensor responding to light and/or heat radiation.

The combination of two or more sensors in the target detector affords a high immunity against possible deception efforts of the enemy. It is possible to include the great iron masses (of a tank, for instance) in the target detection during low-level flying because of the very short flight path in the steeply downwardly directed ballistics.

In accordance with a further development of the invention, to the target detector there is assigned a speed measuring equipment which determines the flying speed of the weapons carrier and by means of which the target detector can be rotated in a plane perpendicularly intersecting the flying path about an axis extending transversely of the plane. As a result of this measure, it is possible to rigidly mount the airborne weapon or to forego a speed control of the flying weapons carrier.

In accordance with a further development of the invention, for using the arrangement in unmanned missiles, it is provided to use arrangements according to our older patent application P 25 32 479.2 in which, in a special further development of the invention, the stored radial measurement data comprise linear targets, such as roads, railroad lines or courses of rivers.

In another further development of the invention, the arrangement of an additional, further-reaching target detector is provided which scans the target area transversely of the flying direction and is assigned to the course control of the weapons carrier.

In accordance with a further development of the invention, in all embodiments, conically dispersing ammunition can be assigned to the release of the weapon.

In the following, the invention is described in more detail with the aid of the drawing. In the drawing:

FIG. 2 shows the use of the weapon against road-bound or track-bound vehicles;

FIG. 3 shows the use of the weapon against weapons moving freely on the terrain.

Figure 1:
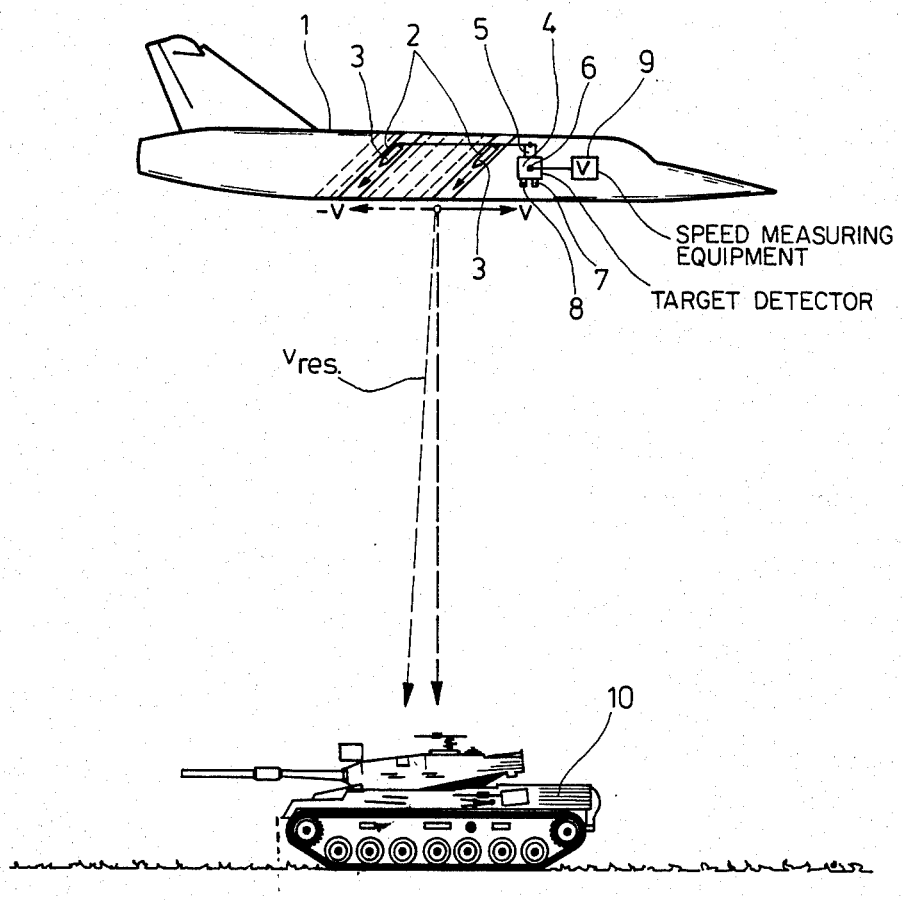
FIG. 1 shows a flying weapons carrier with an arrangement for combatting ground targets.

FIG. 1 shows a flying weapons carrier 1 which may be constructed as a manned or remote control aircraft. This flying weapons carrier 1 is provided with a weapon 2 for combatting ground targets of which, as illustrated, a plurality may be present. This weapon 2 has steeply downwardly directed ballistics, i.e., after leaving the weapon 2, the ammunition 3 to be discharged from the weapon 2 has a resulting velocity vector $V_{res}$ which is directed steeply downwardly and deviates from the vertical by less than 45°. The latter is achieved by mounting the weapon 2 so that the mouth of the weapon is directed obliquely downwardly opposite the flight direction V and by means of a recoilless and suitably dimensioned propellant charge of the ammunition 3 which imparts to the ammunition an oppositely directed, horizontal velocity component −V. In the ideal case, perpendicularly downwardly directed weapons ballistics and weapons discharge speed result, wherein the flying altitude of the weapons carrier 1 has no influence on the miss distance. Specifically for using the weapon 2 in low-level flight, to the release 5 of the weapon 2 a target detector 4 of relatively short reach is assigned which is directed downwardly almost parallel to the direction of the resulting velocity vector $V_{res}$. In an accurate combat of stationary or moving ground targets, by means of the above-described weapons, significant savings in technical apparatus are achieved as compared to weapons of the conventional type. For example, the rigid mounting of the weapon 2 makes it possible to avoid the entire apparatus for a movable support of the weapon and, furthermore, it is possible to use a sensor 4 of a relatively short reach which, in the intended case of application, has a significantly higher target recognition ability than those sensors which are required, for example, in weapons which drop or discharge in the direction of flight. When used in manned weapons carriers—and possibly against the influence of light defensive weapons on the ground of armored weapons carriers—the use of the weapon results in the further advantage that the crew of the weapons carrier is able to fully concentrate on the control of the aircraft and does not have to operate a sighting device or a weapons release. To be able to distinguish true targets 10 from decoy targets, the target detector 4 is provided with a plurality of sensors which respond to different properties of the target 10, for example, a sensor 7 which responds to disturbances of the terrestrial magnetic field due to great iron masses and a sensor 8 which responds to stray magnetic fields of electrically excited systems of the target or to light or heat radiation of the target. Aside from recognizing decoy targets which results in a locking of the weapons release, by means of these devices it is also possible to select true targets, for example, the distinction of normal road vehicles, tanks and ammunition depots. This selection can be further improved by constructing at least one of the sensors 7 or 8 with an adjustable threshold value.

The target detector 4 is advantageously rotatable about an axis 6 which extends transversely of a plane extending perpendiculary through the flying path of the weapons carrier 1 and about which the target detector 4 can be rotated by means of a speed measuring equipment 9 which is assigned to the detector 4 and measures the speed of the weapons carrier 1. This measure makes it unnecessary for the pilot or the control of the flying weapons carrier 1 to maintain an exactly defined speed when carrying out an attack mission, wherein deviations of $\pm 45°$ from the vertical for the resulting velocity vector $V_{res}$ of the ammunition 3 are made possible while the hit accuracy remains the same.

For further relieving the pilot of a flying weapons carrier, or for the use of a remote-controlled, flying weapons carrier, the weapons carrier is provided with a storage for target coordinates and a radio measuring equipment in accordance with our older applications P 25 32 479.2 and P 26 27 183.0. Particularly for combatting track-bound road or rail vehicles or ships on canals or rivers, a storage for linear target coordinates is provided. An attack by means of these devices is illustrated in FIG. 2 which shows a flying weapons carrier 11 which moves in a plane 12 extending perpendicularly of a linear target area 13. When flying over the targets 14 to 16, in the manner described with reference to FIG. 1, by means of an also already described target detector 18, a successive, accurate combat of the individual targets is carried out, wherein, compared to the series release of ammunition, significant savings are made possible, even when dispersing weapons are used within the dimensions of an individual target.

Furthermore, the above-described arrangement can also be used against ground targets which are freely movable over the terrain, if the weapons carrier 1 is provided with an additional, further-reaching target sensor 22 which scans the ground transversely of the perpendicular plane 23 extending through the flying path. An attack at targets of the above-mentioned type is schematically illustrated in FIG. 3.

The airborne weapons of the flying weapons carrier 21 are released in the same manner as described with reference to FIGS. 1 and 2, wherein all the advantages indicated with respect to FIGS. 1 and 2 are preserved. When combatting freely movable ground targets by means of a flying weapons carrier 21 controlled by a pilot, the use of a far-reaching additional sensor 22 can be forgone when the visibility is sufficient.

I claim:

1. Arrangement in a low-flying weapons carrier comprising a manned or remote control aircraft for combatting ground targets, a weapon located in said weapon carrier, said weapon arranged to hold a plurality of ammunition members for attacking ground targets and said weapon having steeply downwardly directed ballistics, a release 5 in said weapon carrier for said weapon 2, a target detector 4 in said weapon carrier separate from said weapon and assigned to said release, said target detector is of relatively short reach which is directed steeply downwardly and parallel to the direction of the resulting velocity vector $V_{res}$ of the ammunition members 3 to be discharged from said weapon.

2. Arrangement according to claim 1, characterized in that said target detector 4 has a plurality of sensors 7 and 8 each responding to different properties of the target 10.

3. Arrangement according to claim 2, characterized in that said target detector 4 has a sensor responsive to light and/or heat radiation.

4. Arrangement in low-flying weapons carriers for combatting ground targets which are to be attacked by means of a weapon having steeply downwardly directed ballistics, characterized in that to the release 5 of said weapon 2 there is assigned a target detector 4 of relatively short reach which is directed steeply downwardly and parallel of the direction of the resulting velocity vector $V_{res}$ of the ammunition 3 to be discharged, said target detector has a plurality of sensors 7 and 8 which respond to different properties of the target, and the threshold value of at least one of said sensors 7 or 8 of said target detector 4 is adjustable.

5. Arrangement in low-flying weapons carriers for combatting ground targets which are to be attacked by means of a weapon having steeply downwardly directed ballistics, characterized in that to the release 5 of said weapon 2 there is assigned a target detector 4 of relatively short reach which is directed steeply downwardly and parallel of the direction of the resulting velocity vector $V_{res}$ of the ammunition 3 to be discharged, said target detector has a plurality of sensors 7 and 8 which respond to different properties of the target, and said target detector 4 has an active or passive sensor 7 or 8 for evaluating the magnetic field surrounding the target.

6. Arrangement in low-flying weapons carriers for combatting ground targets which are to be attacked by means of a weapon having steeply downwardly directed ballistics, characterized in that to the release 5 of said weapon 2 there is assigned a target detector 4 of relatively short reach which is directed steeply downwardly and parallel of the direction of the resulting velocity vector $V_{res}$ of the ammunition 3 to be discharged, said target detector has a plurality of sensors 7 and 8 which respond to different properties of the target, and said target detector 4 has a sensor 7 or 8 which responds to stray electromagnetic or quasi-magnetostatic fields of electrically excited devices of the target.

7. Arrangement according to one of claims 1 to 6, characterized in that said weapons carrier 11 is remote-controlled by means of radio distance measuring equipment data stored in said weapons carrier and by additional, continuously measured radio distance measuring equipment data.

8. Arrangement according to claim 7, characterized in that said stored radio measurement data comprise line targets 13, such as roads, railroad tracks or courses of rivers.

9. Arrangement according to one of claims 1 to 6, characterized in that said flying weapons carrier 21 is provided with an additional further-reaching target detector 22 which scans the target area transversely of the flight direction and is assigned to the course control of said weapons carrier 21.

10. Arrangement according to claim 9, characterized in that conically dispersing ammunition 3 is assigned to said release 5 of said weapon 2.

11. Arrangement in low-flying weapons carriers for combatting ground targets which are to be attacked by means of a weapon having steeply downwardly directed ballistics, characterized in that to the release 5 of said weapon 2 there is assigned a target detector 4 of relatively short reach which is directed steeply downwardly and parallel of the direction of the resulting velocity vector $V_{res}$ of the ammunition 3 to be discharged, said target detector has a plurality of sensors 7 and 8 which respond to different properties of the target, and said target detector 4 can be rotated by means of a speed measuring equipment 9 assigned to said detector and determining the flying speed of said weapons carrier in a plane 12 (FIG. 2) perpendicularly intersecting the flying path about an axis 6 extending transversely of said plane.

* * * * *